US006945435B2

(12) United States Patent
Salamini

(10) Patent No.: US 6,945,435 B2
(45) Date of Patent: Sep. 20, 2005

(54) USER-REFILLABLE LIQUID DISPENSING CONTAINER WITH VACUUM ACTUATED PISTON

(75) Inventor: Alexey Salamini, San Francisco, CA (US)

(73) Assignee: Helen of Troy Limited, Bridgetown (BB)

( * ) Notice: Subject to any disclaimer, the term of this patent is extended or adjusted under 35 U.S.C. 154(b) by 0 days.

(21) Appl. No.: 10/418,648

(22) Filed: Apr. 17, 2003

(65) Prior Publication Data

US 2004/0206782 A1 Oct. 21, 2004

(51) Int. Cl.[7] ..... B67D 5/00

(52) U.S. Cl. ..... 222/386; 222/383.1; 222/387; 222/389; 222/1

(58) Field of Search ..... 222/1, 256, 383.1, 222/384, 386, 387, 389

(56) References Cited

U.S. PATENT DOCUMENTS

| | | | | |
|---|---|---|---|---|
| 2,409,619 | A | | 10/1946 | Fitch |
| 3,459,341 | A | * | 8/1969 | Copeland ..... 222/386 |
| 3,520,452 | A | | 7/1970 | Malone |
| 4,505,310 | A | | 3/1985 | Schneider |
| 4,846,810 | A | | 7/1989 | Gerber |
| 5,178,300 | A | | 1/1993 | Haviv et al. |
| 5,295,615 | A | | 3/1994 | Gentile |
| 5,449,094 | A | * | 9/1995 | Behar et al. ..... 222/321.3 |
| 5,474,212 | A | | 12/1995 | Ichikawa et al. |
| 5,540,360 | A | | 7/1996 | Foster et al. |
| 5,788,124 | A | | 8/1998 | Bougamont et al. |
| 5,848,739 | A | | 12/1998 | Wilkinson |
| 6,070,763 | A | | 6/2000 | Gueret |
| 6,220,311 | B1 | | 4/2001 | Litto |
| 6,302,304 | B1 | | 10/2001 | Spencer |
| 6,510,965 | B1 | | 1/2003 | Decottignies et al. |
| 2002/0170988 | A1 | | 11/2002 | Norville et al. |
| 2004/0084482 | A1 | * | 5/2004 | Sumner et al. ..... 222/387 |

* cited by examiner

*Primary Examiner*—J. Casimer Jacyna
(74) *Attorney, Agent, or Firm*—Seyfarth Shaw LLP

(57) ABSTRACT

A liquid dispensing container capable of dispensing liquid in any orientation, the container having a neck and a body defining a cavity, the cavity having an inner wall and a rearwardly disposed opening. A removable liquid dispensing structure is fluid-tightly disposed on the neck, and a piston is disposed within the cavity and has a peripheral edge disposed in sliding, fluid-tight engagement with the inner wall of the cavity and capable of axial movement caused by negative pressure within the cavity when liquid is dispensed via the dispensing structure.

18 Claims, 4 Drawing Sheets

USER-REFILLABLE LIQUID DISPENSING CONTAINER WITH VACUUM ACTUATED PISTON

BACKGROUND

The present application relates generally to user-refillable liquid dispensing containers and, more particularly, to user-refillable liquid dispensing containers which permit the dispensing of liquid in any orientation of the container.

Typical user-refillable liquid dispensing containers, such as spray bottles commonly associated with glass cleaners and the like, must be oriented in such a manner as to ensure that the feed tube connected to the spray mechanism is continually submerged in the liquid within the container in order to deliver the liquid to the spray mechanism. To permit substantial emptying of the container, the open end of the feed tube is disposed close to the bottom of the container. Such liquid dispensing containers thus cannot be used in any orientation, for example inverted, wherein the open end of the feed tube will not be submerged within the liquid and thus not capable of delivering the liquid to the spray mechanism as required.

It is known that by dynamically adjusting the capacity of a liquid container, liquid can be adequately delivered to the spray mechanism in any orientation. Prior methods have used spring-assisted pistons disposed within the container to accomplish this. In such a construction, a spring causes the piston to maintain a constant pressure on the remaining liquid while also adjusting the capacity of the container. However, a limitation of such an invention is that the spring may cause excessive pressure on the liquid because it does not rely on natural vacuum-assisted movement of the piston when the liquid is dispensed.

SUMMARY

The present application discloses a user-refillable liquid dispensing container capable of dispensing liquid in any orientation, for example, inverted, upright, or tilted left or right. The container may have a generally cylindrical design defining a cavity with a bottom opening and a neck in communication with the cavity. A liquid dispensing mechanism or structure is removably disposed on the neck in a fluid-tight manner in order to maintain a negative pressure within the cavity during operation. A slideable piston is disposed within the cavity through the bottom opening and is adapted to move in an axial manner relative thereto. An elastomeric seal may be disposed around the peripheral edge of the piston to provide a fluid-tight seal between the piston and the inner wall of the cavity.

A generally centrally located aperture may be disposed within the piston. A pull rod, having a diameter less than the diameter of the aperture, may be received within the aperture and adapted to slide relative thereto. An elastomeric seal may be disposed between the periphery of the pull rod and the edge of the aperture to provide a fluid-tight seal between the pull rod and aperture. The pull rod may have a first end protruding through the aperture with an extension adapted to prevent retraction of the first end through the aperture when an axial force is applied to the pull rod in a well-known pulling manner via a second end, which is accessible outside of the cavity. Such a feature allows the user to pull the piston to a refill position and toward the opening when desired.

The piston may have a retaining structure disposed adjacent the aperture for retainable engagement with an engagement structure on the pull rod. As such, when the pull rod is rotated relative to the piston, the engagement structure may retainably engage the retaining structure and the pull rod is thereafter adapted to facilitate axial movement of the piston in either a generally pushing or pulling fashion. Such a feature allows the user to remove air from the container prior to disposing the removable liquid dispensing mechanism or structure on the neck, thus adapting the container to maintain a negative pressure within the cavity when liquid is dispensed via the liquid dispensing mechanism or structure.

Upon assembly and operatively dispensing of liquid through the liquid dispensing mechanism or structure, negative pressure is developed within the cavity causing the piston to move axially within the container and toward the neck, thus automatically adjusting the capacity within the cavity to ensure that encapsulated air within the cavity is minimized and that liquid can be consistently delivered through the dispensing mechanism or structure in any orientation. When the container needs to be refilled, the user can remove the liquid dispensing mechanism or structure, pull on the pull rod in a well-known manner, thus retracting the piston to increase the available capacity within the container, fill the container with a liquid, remove any remaining air within the cavity, and replace the liquid dispensing mechanism or structure. The user can remove any remaining air by either completely filling the container with liquid or by causing the pull rod to retainably engage the piston to facilitate movement of the piston toward the neck by pushing on the pull rod in a well known manner, thus adaptively modifying the capacity of the cavity. During liquid dispensing operation, the pull rod can be stowed within the container by disengaging the retaining structure and extending the pull rod into the cavity.

BRIEF DESCRIPTION OF THE DRAWINGS

For the purpose of facilitating an understanding of the subject matter sought to be protected, there is illustrated in the accompanying drawings embodiments thereof, from an inspection of which, when considered in connection with the following description, the subject matter sought to be protected, its construction and operation, and many of its advantages, should be readily understood and appreciated.

DETAILED DESCRIPTION

Figure 1:
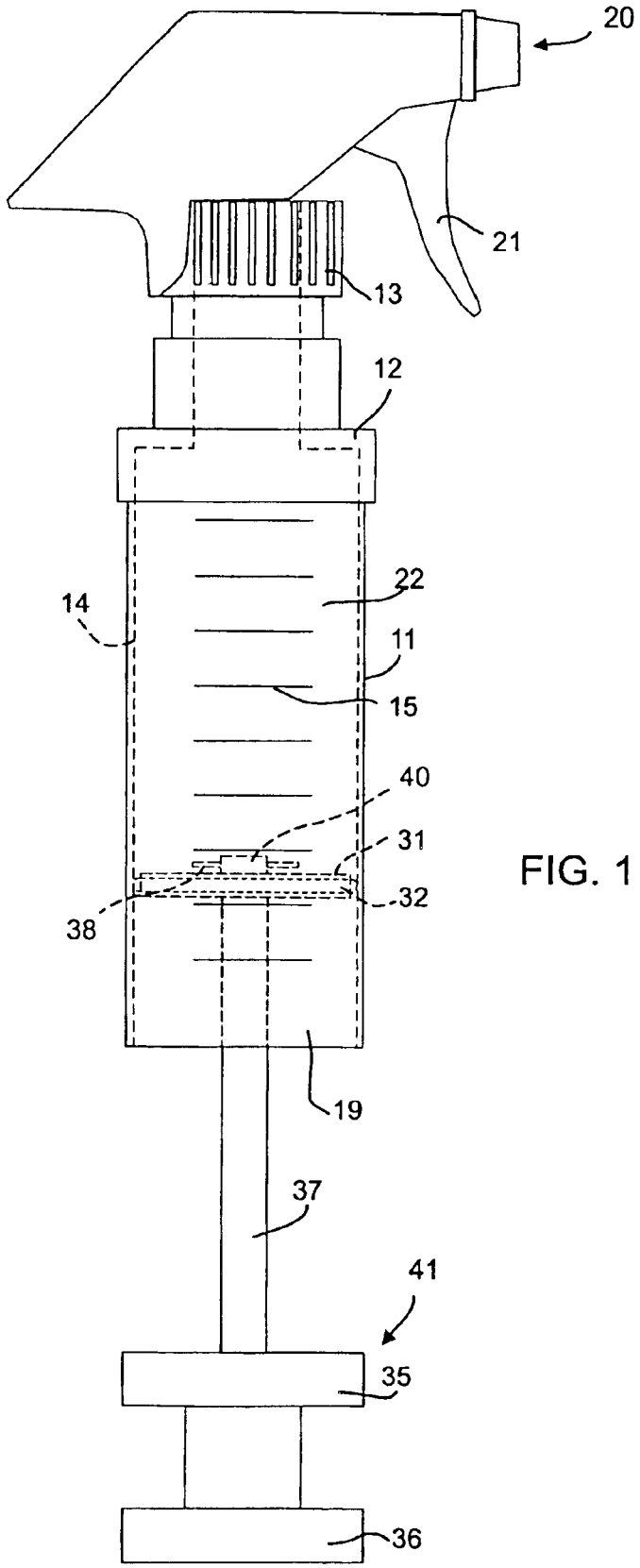
FIG. 1 is a side, assembled view of an embodiment of a liquid dispensing container in accordance with the present application.

The present application discloses a user-refillable liquid dispensing container capable of dispensing liquid in any orientation, for example, inverted, upright or tilted left or right. Referring to FIGS. 1–3*a*, a first embodiment of the fluid dispensing container 10 of the present application is shown. The container 10 may comprise a generally cylindrical body 11 defining a cavity 22 having an inner wall 14 and a generally rearwardly disposed opening 19. The container 10 may have a plurality of external graduated markings 15 representing quantitative capacity of the cavity 22.

The body 11 may also have a generally annular neck portion 17. The neck portion 17 may have threads on its external periphery.

A liquid dispensing structure or mechanism 20 may be removably disposed on the neck portion 17 of the container 10 in a substantially fluid-tight manner. The liquid dispensing structure or mechanism 20 may have an annular collar 13 with internal threads for threaded engagement with the threads of the neck portion 17 in a well-known manner. The liquid dispensing structure or mechanism 20 may be any type of dispensing structure, such as a manual pump mechanism. As such, it will be appreciated that, while a conventional liquid dispensing sprayer 21 with a finger-trigger is shown, other liquid dispensing structures or mechanisms may be effectively used with the container of the present application while not departing from the true scope and spirit thereof.

A piston 31 is slideably disposed within the cavity 22 via the opening 19, thereby allowing the piston to move in an axial manner relative to the cavity 22. The piston 31 may be constructed of a rigid material. The piston 31 has a peripheral edge which is adjacent to the inner wall 14 when the piston 31 is disposed within the cavity 22. The peripheral edge may include an elastomeric seal 32 to provide a substantially fluid-tight seal between the inner wall 14 and piston 31.

A pull rod 37 may be adaptively disposed on the piston 31 to facilitate axial movement of the piston 31 within the cavity 22 when an axial force is applied to the pull rod 37 in a well-known manner. The pull rod 37 may further be stowable within the cavity 22 during use.

The piston 31 may have a generally centrally disposed pull rod aperture 34 (FIG. 3*a*) having a diameter and an aperture edge. The pull rod 37 may have a diameter less than the pull rod aperture 34 and be slideably disposed therein. The pull rod 37 may further include a first end 40 and a second end 41. The first end 40 may include at least one extension 38 adapted to prevent the first end 40 from being withdrawn from the pull rod aperture 34 when an axial force is applied to the pull rod 37 in a manner to cause the piston 31 to axially move toward the opening 19. The second end 41 may include a handle 36 to facilitate application of an axial force to the piston 31. The second end 41 may further include a base 35.

The aperture edge may include an elastomeric seal 39 (FIG. 3*a*) to create a substantially fluid-tight seal between the pull rod 37 and the aperture edge while accommodating slideable movement of the pull rod 37 within the pull rod aperture 34.

Figure 2:
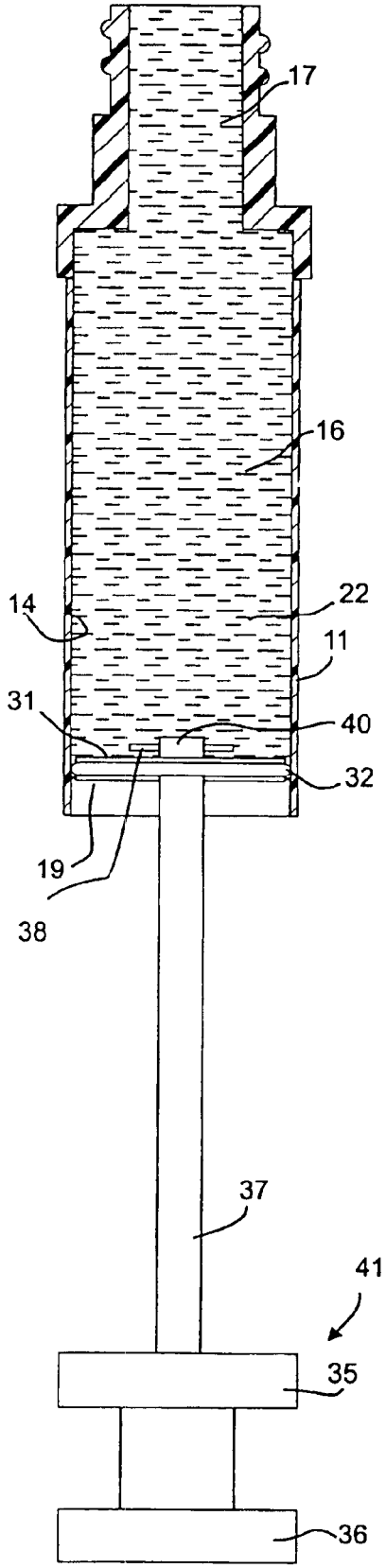
FIG. 2 is a side view in partial section of the liquid dispensing container of FIG. 1 with the piston fully retracted, and the dispensing mechanism removed for clarity.
Figure 3:
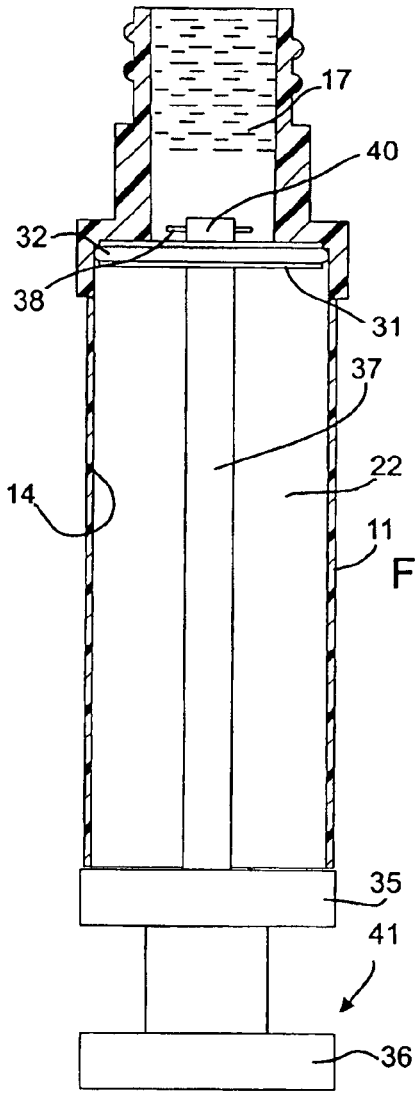
FIG. 3 is a view similar to FIG. 2 with the piston fully extended.
Figure 3A:
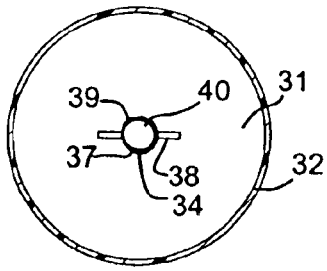
FIG. 3*a* is an enlarged top plan view of the piston of FIG. 1.
Figure 4:
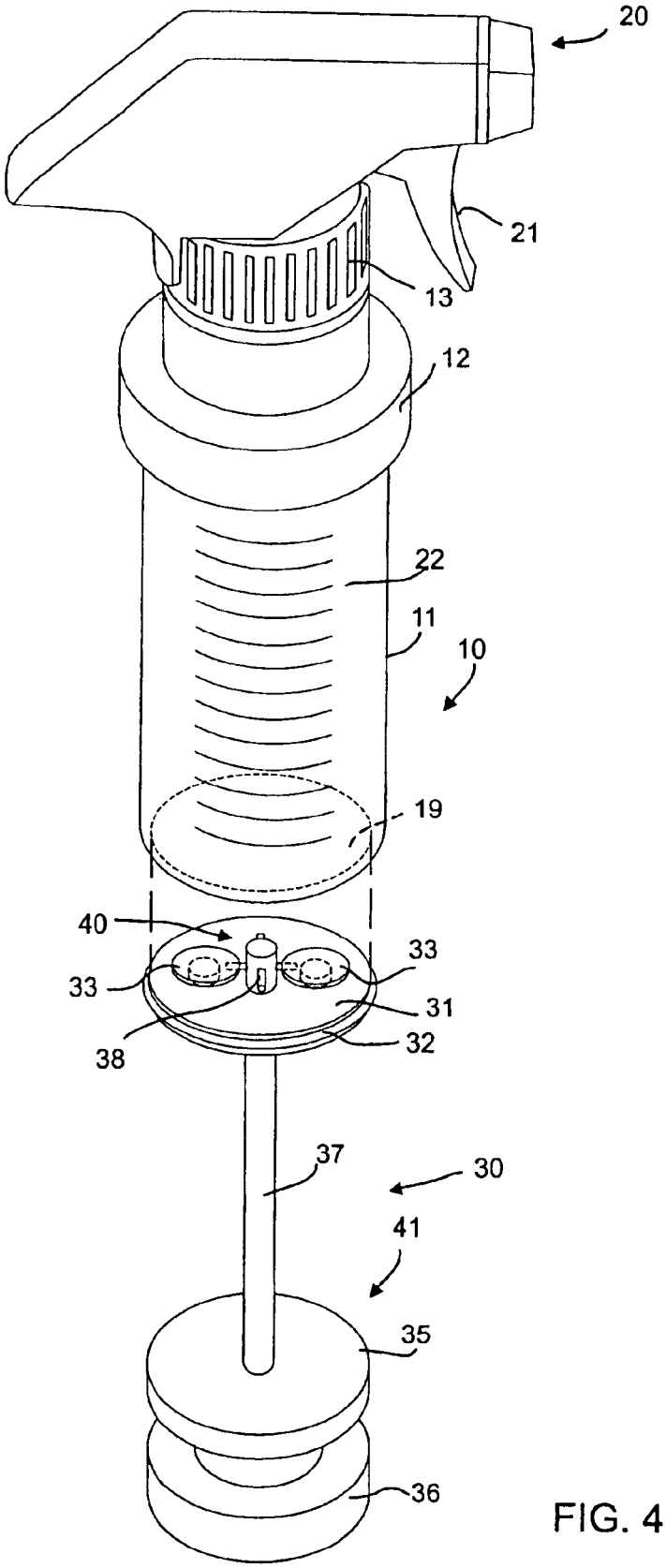
FIG. 4 is an exploded, perspective view of another embodiment of a liquid dispensing container in accordance with the present application.
Figure 5:
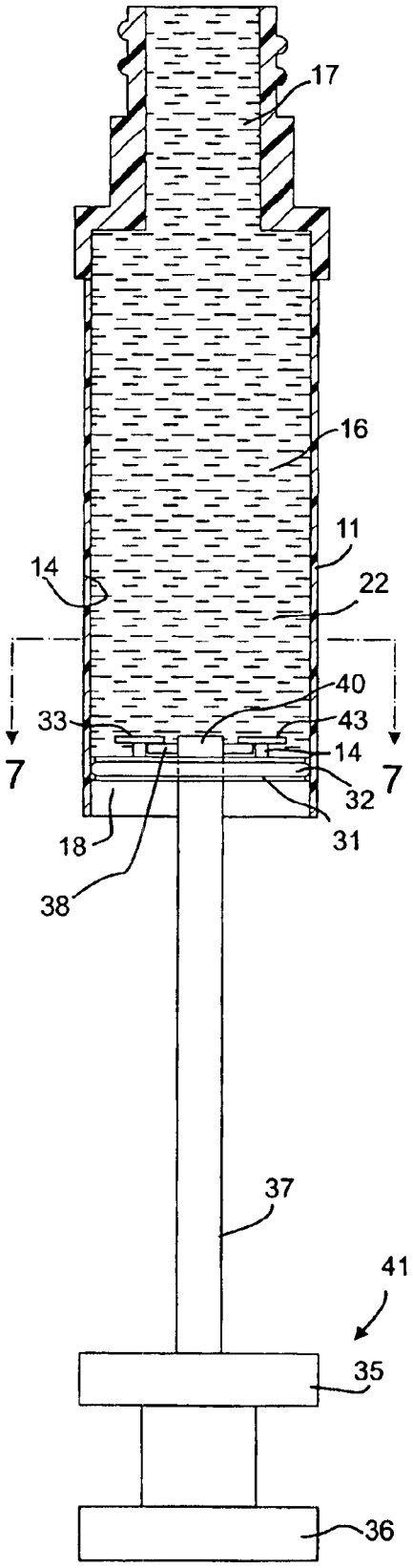
FIG. 5 is a view similar to FIG. 2 of the liquid dispensing container of FIG. 4.

Referring to FIG. 2, the cavity 22 is depicted filled with a desired liquid 16 intended to be dispensed and the piston 31 in a fully retracted position toward the opening 19. With the piston 31 in such a position, the capacity of the cavity 22 is maximized. The pull rod 37 is further depicted in a fully extended position. Referring to FIG. 3, the piston 31 is depicted in a fully extended position toward the neck portion 17 when the liquid 16 in the cavity 22 has been dispensed, thus minimizing the capacity of the cavity 22.

Referring to FIGS. 4–7, another embodiment of the fluid container is depicted, designated 10A, which is similar to the container 10. Like elements of the containers 10 and 10A have been depicted with like numerals. The piston 31 may include a retaining structure 33 disposed adjacent to the pull rod aperture 34 and the pull rod 37 may include an engagement structure 38 adapted for retainable engagement with the retaining structure 33 when the pull rod 37 is rotated relative to the piston 31.

The retaining structure 33 may include an arm 42 integral with the piston 31 and a disc-like leg 43 integral with the arm 42 and extending laterally toward the pull rod aperture 34. The leg 43 thus defines a retaining lip which cooperates with the piston 31 to define a retaining recess therebetween.

The pull rod 37 engagement structure may include at least one extension 38. In such a case, the arm 42 is of such a length to facilitate retainably disposing the extension 38 within the retaining recess when the pull rod 37 is rotated relative to the piston 31. It is anticipated that the pull rod 37 can thus be used to axially move the piston either towards the neck portion 17 or the opening 19 with an axial force applied to the pull rod 37 in a well-known manner.

Figure 6:
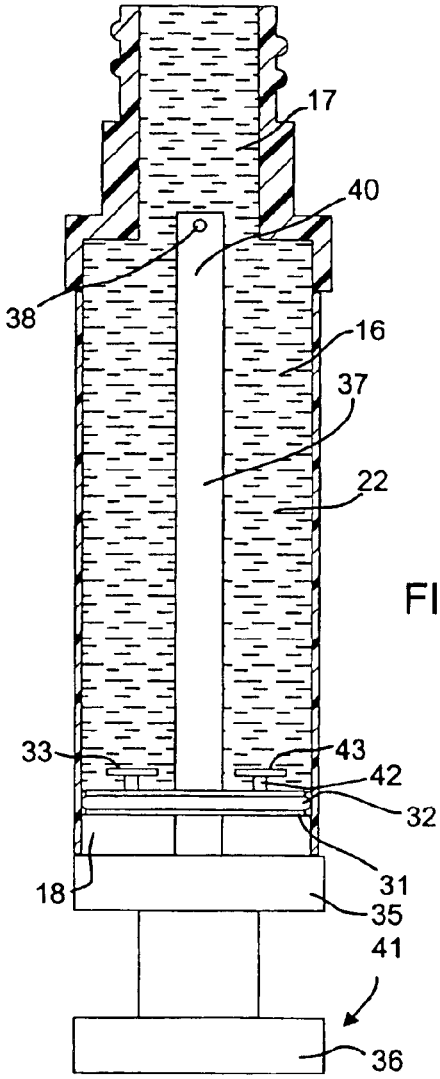
FIG. 6 is a view similar to FIG. 5 with the piston rod retracted inside the container.
Figure 7:
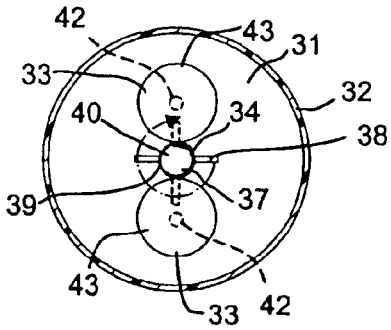
FIG. 7 is an enlarged cross-sectional view of the liquid dispensing container of FIG. 5 taken along line 7—7 therein.

It will be appreciated that, during operation, when a desired liquid 16 is dispensed via the liquid dispensing mechanism or structure 20, negative pressure will be developed within the cavity 22 because of the fluid-tight sealing thereof. Thus, the pressure differential on opposite sides of the piston 31 will cause it to move in a generally axial manner toward the neck portion 17 of the container 10. Such vacuum-assisted actuation of the piston 31 facilitates dynamic capacity adjustment of the container 10 and thus allows delivery of the liquid 16 to the liquid dispensing mechanism or structure 20 in any orientation. When the liquid 16 is depleted, or when the user wishes to replenish the cavity 22 with additional liquid 16, the piston 31 can be retracted via the pull rod 37 by pulling on the piston 31 in a well-known manner. When the piston 31 is in its desired position, the pull rod 37 can be disengaged from the engagement structure 33 and thus stowed within the cavity 22 during use, as depicted in FIG. 6.

A method of dispensing liquid in any orientation is further disclosed. A fluid dispensing container has a neck portion and a body defining a cavity with an inner wall and a generally rearwardly disposed opening. The method comprises slideably disposing a piston having a peripheral edge within the cavity so that the peripheral edge is adjacent to the inner wall, in a substantially fluid-tight relationship, filling the cavity with a desired liquid to be dispensed, removing any excess air from the cavity, disposing a liquid dispensing structure or mechanism on the neck portion in a substantially fluid-tight manner, and dispensing the liquid via the liquid dispensing structure or mechanism, wherein the dispensing operation causes negative pressure within the cavity to automatically actuate the piston toward the neck portion to allow dynamic capacity adjustment of the cavity and thus facilitate continuous liquid delivery to the liquid dispensing structure or mechanism.

The process of filling the cavity with the liquid may include slideably actuating the piston in an axial manner relative to the cavity and towards the opening with a pull rod adapted to actuate the piston. The step of removing excess air from the cavity may include slideably actuating the piston in an axial manner relative to the cavity and towards the neck portion with a pull rod that is adapted to actuate the piston in such a direction.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

I claim:

1. A user-fillable liquid dispensing container capable of dispensing liquid in any orientation, comprising:

a body having a neck portion and defining a cavity, the cavity having an inner wall and a rearwardly disposed opening;

a removable liquid dispensing structure disposed in a substantially fluid-tight engagement with the neck portion and capable of promoting a negative pressure within the cavity when liquid is dispensed therethrough; and a piston slideably disposed within the cavity and having a peripheral edge disposed in a substantially fluid-tight sealing relationship with the inner wall, the piston being responsive to negative pressure when liquid is dispensed via the liquid dispensing structure for movement toward the neck and capable of being retracted by a user in order to fill the cavity with liquid.

2. The container as claimed in claim 1 wherein the piston is constructed of a rigid material.

3. The container as claimed in claim 1 further comprising a pull rod adapted to facilitate axial movement of the piston within the cavity when an axial force is applied thereto.

4. The container as claimed in claim 3 wherein the piston includes a generally centrally disposed pull rod aperture having a diameter and an aperture edge.

5. The container as claimed in claim 4 wherein the pull rod has a diameter less than the diameter of the pull rod aperture and is slideably received therein, the pull rod including first and second ends, the first end having at least one extension adapted to prevent the first end from being withdrawn from the pull rod aperture when an axial force is applied to the pull rod in a manner to cause the piston to move axially toward the opening.

6. The container as claimed in claim 5 wherein the second end includes a handle to facilitate application of an axial force to the piston thereby causing the piston to move toward the opening.

7. The container as claimed in claim 5 wherein the aperture edge includes an elastomeric seal thereby creating a fluid-tight seal between the pull rod and the aperture edge.

8. The container as claimed in claim 5 wherein the piston includes a retaining structure disposed adjacent to the pull rod aperture.

9. The container as claimed in claim 8 wherein the pull rod includes an engagement structure adapted for retainable engagement with the retaining structure when the pull rod is rotated relative to the piston.

10. The container as claimed in claim 9 wherein the retaining structure includes an arm integral with the piston and disposed adjacent the pull rod aperture and a leg integral with the arm and generally extending towards the pull rod aperture and defining a retaining lip between the piston and the leg, the arm having a length to facilitate disposing the engagement structure between the retaining lip and the piston.

11. The container as claimed in claim 1 wherein the piston includes an elastomeric seal disposed on the peripheral edge thereby creating a fluid-tight seal between the inner wall and the peripheral edge.

12. A liquid dispensing container comprising:

a body having a neck portion and defining a cavity, the cavity having an inner wall and a rearwardly disposed opening;

a removable liquid dispensing structure disposed on the neck and capable of dispensing liquid therethrough;

a piston slicleably disposed within the cavity and having a peripheral edge adjacent the inner wall in a fluid-tight sealing relationship therewith and a generally centrally disposed pull rod apexture having a diameter and an aperture edge, the piston being moveable in an axial direction within the cavity and further having a retaining structure disposed adjacent the pull rod aperture; and a pull rod having a diameter less than the pull rod aperture and being slideably received therein, the pull rod having first and second ends, the first end having at least one extension adapted to prevent the first end from being withdrawn from the pull rod aperture when an axial force is applied to the pull rod in a manner to cause the piston to axially move toward the opening and an engagement structure adapted for retainable engagement with the retaining structure when the pull rod is rotated relative to the piston.

13. The container as claimed in claim 12 wherein the retaining structure includes an arm integral with the piston and disposed adjacent to the pull rod aperture and a leg integral with the arm and generally extending towards the pull rod aperture and defining a retaining lip between the piston and the leg, the arm having a length to facilitate disposing the engagement structure between the retaining lip and the piston.

14. The container as claimed in claim 12 wherein the piston includes an elastomeric seal disposed on the peripheral edge.

15. The container as claimed in claim 12 wherein the pull rod aperture edge includes an elastomeric seal.

16. The container as claimed in claim 12 wherein the second end includes a handle to facilitate application of an axial force to the piston for causing the piston to move in an axial manner toward the opening.

17. A method of dispensing a liquid from a container in any orientation of the container, the container having a neck portion and a body defining a cavity, the cavity having an inner wall and a rearwardly disposed opening, the method comprising:

slideably disposing a rigid piston having a peripheral edge in the cavity wherein the peripheral edge is adjacent the inner wall in a substantially fluid-tight relationship;

filling the cavity with a liquid;

removing excess air from the cavity by slideably actuating the piston in an axial manner relative to the cavity toward the neck portion;

disposing a liquid dispensing structure on the neck portion in a substantially fluid-tight manner; and dispensing the liquid from the container in any orientation, thereby vacuum-actuating the piston in an axial direction relative to the cavity toward the neck portion.

18. The method as claimed in claim 17 wherein the step of filling the cavity with a liquid includes slideably actuating the piston in an axial manner relative to the cavity toward the opening.

* * * * *

UNITED STATES PATENT AND TRADEMARK OFFICE

CERTIFICATE OF CORRECTION

PATENT NO. : 6,945,435 B2
APPLICATION NO. : 10/418648
DATED : September 20, 2005
INVENTOR(S) : Alexey Salamini It is certified that error appears in the above-identified patent and that said Letters Patent is hereby corrected as shown below:

Column 6

Claim 12; line 7 "slicleably" should be "slideably".

Column 6

Claim 12; line 10 "apexture" should be "aperture".

Signed and Sealed this

Second Day of December, 2008

JON W. DUDAS
*Director of the United States Patent and Trademark Office*